US005580006A

United States Patent [19]

Hennenfent et al.

[11] Patent Number: 5,580,006

[45] Date of Patent: Dec. 3, 1996

[54] SPROCKET CRUSHER

[75] Inventors: Douglas J. Hennenfent, New Hope; Lloyd M. Thorndyke, Edina, both of Minn.

[73] Assignee: Recyclights, Inc., Bloomington, Minn.

[21] Appl. No.: 368,482

[22] Filed: Jan. 4, 1995

[51] Int. Cl.[6] ..... B02C 15/16

[52] U.S. Cl. ..... 241/159; 241/236; 241/255.2

[58] Field of Search ..... 241/99, 236, 159, 241/293, 232, 233, 234, 32, 101.2, 37, 290, 285.2, 289

[56] References Cited

U.S. PATENT DOCUMENTS

| | | | |
|---|---|---|---|
| 315,523 | 4/1985 | Lynett . | |
| 674,057 | 5/1901 | Edison . | |
| 2,558,321 | 6/1951 | Steinmetz | 241/290 X |
| 2,593,657 | 4/1952 | Coon et al. . | |
| 2,620,988 | 12/1952 | Tellier . | |
| 2,628,036 | 2/1953 | Hall . | |
| 2,843,330 | 7/1958 | Gundlach . | |
| 2,866,604 | 12/1958 | Hall . | |
| 3,208,677 | 9/1965 | Hesse | 241/236 X |
| 3,330,489 | 7/1967 | Worman . | |
| 3,623,672 | 11/1971 | DeFrank . | |
| 3,727,850 | 4/1973 | Krigbaum | 241/236 X |
| 3,889,886 | 6/1975 | Spivey . | |
| 3,913,849 | 10/1975 | Atanasoff et al. . | |
| 3,958,765 | 5/1976 | Musselman . | |
| 4,046,324 | 9/1977 | Chambers . | |
| 4,068,805 | 1/1978 | Oswald | 241/236 X |
| 4,136,832 | 1/1979 | Morita et al. . | |
| 4,268,306 | 5/1981 | Björkman . | |
| 4,378,911 | 4/1983 | Adams et al. | 241/285.2 X |
| 4,485,977 | 12/1984 | Silverthorn et al. | 241/290 X |
| 4,545,540 | 10/1985 | Nakamura . | |
| 4,579,287 | 4/1986 | Brown . | |
| 4,607,798 | 8/1986 | Odlin . | |
| 4,655,404 | 4/1987 | Deklerow . | |
| 4,715,838 | 12/1987 | Kulander . | |
| 4,809,915 | 3/1989 | Koffsky et al. . | |
| 4,840,314 | 6/1989 | Kulander . | |
| 4,858,833 | 8/1989 | Hanulik . | |
| 4,860,958 | 8/1989 | Verman . | |
| 4,889,290 | 12/1989 | Koffsky et al. . | |
| 4,971,261 | 11/1990 | Solomons . | |
| 5,042,724 | 8/1991 | Perry . | |
| 5,092,527 | 3/1992 | Perry et al. . | |
| 5,186,331 | 2/1993 | Valster . | |
| 5,328,034 | 7/1994 | Davis . | |

*Primary Examiner*—Mark Rosenbaum
*Attorney, Agent, or Firm*—Patterson & Keough, P.A.

[57] ABSTRACT

A crusher adapted to process a feedstock. The crusher includes a pair of crusher rolls for processing a feedstock, the crusher rolls being disposed in a spaced apart relationship with an axis of each crusher roll parallel to one another. Each crusher roll has a plurality of toothed sprockets spaced along the axis of the crusher roll by a spacer disposed between adjacent sprockets. The sprockets of one crusher roll are interleaved with the sprockets of the other crusher roll such that the sprockets of one crusher roll are aligned with the spacers of the other crusher roll. A lateral displacement device is operably coupled to the pair of crusher rolls and is shiftable between a first position wherein the sprockets and spacers of the pair of crusher rolls are interleaved and a second disengaged position wherein the sprockets and spacers of the pair of crusher rolls are disengaged. The lateral displacement device has a biasing member acting to urge the pair of crusher rolls into the interleaved position.

6 Claims, 4 Drawing Sheets

SPROCKET CRUSHER

FIELD OF THE INVENTION

The field of the invention is a mechanical crusher. More particularly, the present invention is a crusher designed to reduce fluorescent light bulbs and other lamps containing mercury or other conductive vapors.

BACKGROUND OF THE INVENTION

A means is needed to dispose of light bulbs and lamps containing mercury or other conductive vapors in an environmentally sound manner. A fully environmentally sound disposition includes the proper disposal of the various components to which the light bulbs and lamps are ultimately reduced. To this end, it would be helpful if the crusher put those components in a condition to facilitate their further disposal while safely disposing of the potentially harmful heavy metal vapors.

Fluorescent light tubes are formed from elongated cylindrical or tubular glass enclosures which are sealed and then charged with mercury or other conductive vapors. The inside surface of the tube is coated with a fluorescent coating such as phosphorous or other phosphor powders. Mercury vapor is well known as a potentially toxic material.

Mercury containing bulbs are used for street lights and yard lamps. Such lamps are generally bulb shaped and have an inner glass envelope surrounding the light generating components. These lamps also contain mercury vapor and mercury in its liquid state. These lamps must be disposed of without permitting the entrained mercury from escaping to the environment.

A difficulty in reducing such bulbs and lamps is presented by the substantial non-glass content of such bulbs and lamps. This material has principally found in the end cap of the fluorescent tube and in the socket components of the mercury lamps. The materials included are principally plastic, aluminum, brass and lead wires.

In the past, systems designed to reduce fluorescent tubes have included devices for mechanically breaking the glass of the tube. U.S. Pat. No. 5,092,527 discloses a rotating two bladed paddle mounted within a relatively dose fitting housing for breaking fluorescent tubes inserted into the housing. U.S. Pat. No. 4,545,540 includes a device having a stationary set of blades and a interleaved rotary set of blades designed to break the glass of the fluorescent bulb. In such a device, the end caps are permitted to fall into the waste material without being affected by the rotating blade.

In the past, paired, counter rotating drums have been used to reduce input material. Such usages have been common in the mining industry and in the milling of grains and production of livestock feed. U.S. Pat. No. 4,046,324 discloses a solid waste shredder. The patent discloses a device having a fixed relationship between parallel shredding stacks. No provision is made for lateral motion to accommodate the passing of large, relatively incompressible solid waste through the device. U.S. Pat. No. 2,843,330 discloses a compliant geared drive train for use in maintaining a parallel relationship of paired crushing rolls when the rolls are laterally displaced. Similarly, U.S. Pat. No. 674,057 discloses crushing rolls having a wabbling drive system that permits a certain amount of lateral displacement of the rolls in the event that a relatively large piece of feed stock is being passed by the rolls.

None of the aforementioned past devices discloses or teaches the structure of the present invention.

As previously indicated, it is desirable to be able to dispose of the components to which the bulbs and lamps are reduced in an environmentally sound manner. There is a market for cleansed glass that has been reduced to small particles. Additionally, there is a market for aluminum as contained in the end caps, if the aluminum is separated from non-aluminum components, such as plastic and non-aluminum, and conducting wires. The plastics and conducting wires are frequently formed integral to the aluminum end caps of fluorescent light bulbs and present a challenge to separate such materials from the aluminum. In suitably reducing a fluorescent light bulb, it is important to simultaneously work the end cap sufficiently to cause the mechanical separation of the plastic and conducting wire components therefrom.

Accordingly, it would be a decided advantage in the industry to have a crusher suitable for use with fluorescent light bulbs and mercury vapor lamps that reduces the bulbs and lamps to small particles, but does not grind up the aluminum content, so that the aluminum is readily recoverable in a marketable state.

SUMMARY OF THE INVENTION

The present invention meets the above objectives. The glass components of the bulb are reduced to small particles. The crusher is able to accommodate passage of the end caps and to work the end caps sufficiently to separate the plastic and non-conducting metals from the aluminum structure. Accordingly, the components to which the fluorescent bulb has been reduced are in a marketable condition as the fluorescent powder is separated from the glass tube of the lamp as the glass is crushed into small particles. Such powder and the mercury vapor are collected by an air recovery system that is not a part of the present invention.

The present invention has additional desirable features, including relatively small size and relatively low input power requirements. Additionally, the present invention has been designed for continuous throughput of bulbs and lamps. A prototype of the invention has been run at a rate of 6500 fluorescent tubes per hour. Further, the device of the present invention is constructed of relatively simple and commonly available materials and components in order to minimize unit cost. This is important in order to make the recycling as attractive as possible to potential users. As is well known, the profit margins in the recycling business are notoriously slim. While the recycling of materials is virtually universally seen as essential activity, the economic incentives to recycle are not yet very strong. Accordingly, the recycling work must be performed in as efficient a manner as possible.

The crusher is adapted to process a feedstock. The crusher includes a pair of crusher rolls for processing a feedstock, the crusher rolls being disposed in a spaced apart relationship with an axis of each crusher roll parallel to one another. Each crusher roll has a plurality of toothed sprockets spaced along the axis of the crusher roll by a spacer disposed between adjacent sprockets. The sprockets of one crusher roll are interleaved with the sprockets of the other crusher roll such that the sprockets of one crusher roll are aligned with the spacers of the other crusher roll. These interleaved sprockets are designed to catch the longer pieces of glass and pull the longer pieces into the crusher for further size reduction.

A lateral displacement device is operably coupled to the pair of crusher rolls and is shiftable between a first position wherein the sprockets and spacers of the pair of crusher rolls are interleaved and a second disengaged position wherein the sprockets and spacers of the pair of crusher rolls are disengaged. The lateral displacement device has a biasing member acting to urge the pair of crusher rolls into the interleaved position. The amount of compressive force exerted by the biasing member is a significant factor in determining the processed material size and the amount of deformation that the aluminum components undergo as a result of passage between the interleaved sprockets.

DETAILED DESCRIPTION OF THE DRAWINGS

DETAILED DESCRIPTION OF THE DRAWINGS

Figure 1:
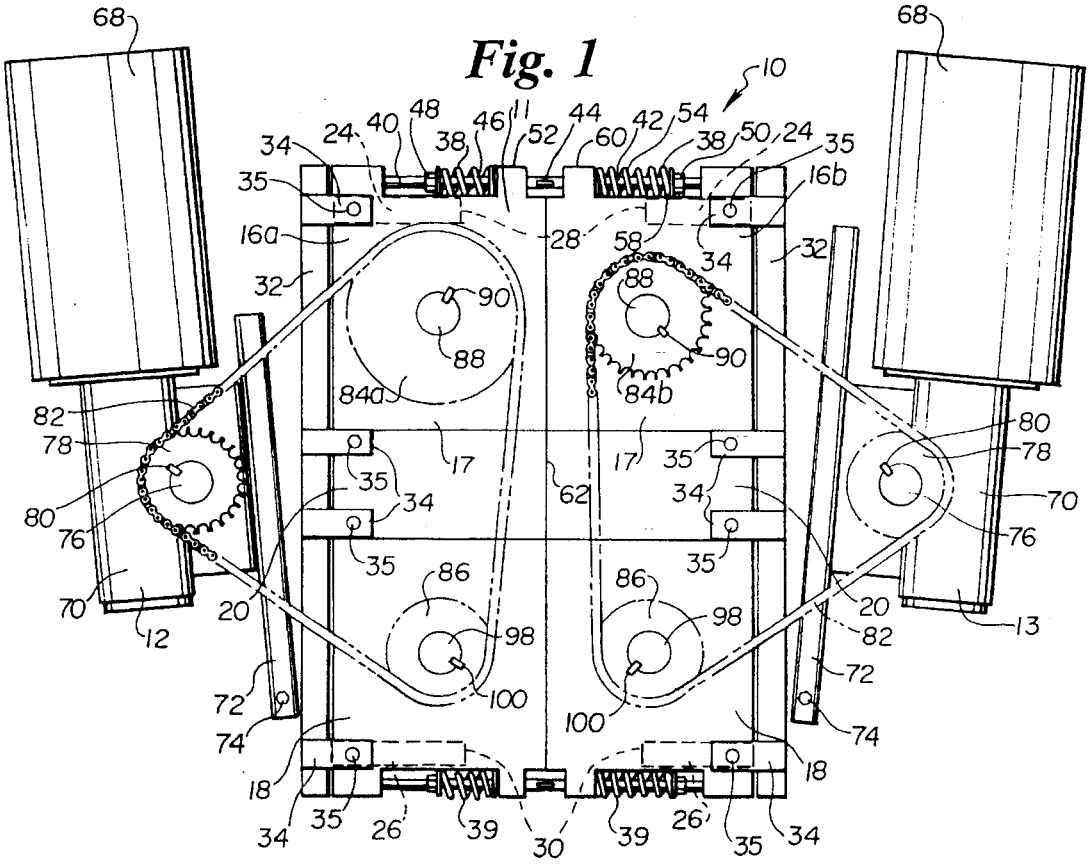
FIG. 1 is a side elevational view of an embodiment of the present invention.
Figure 2:
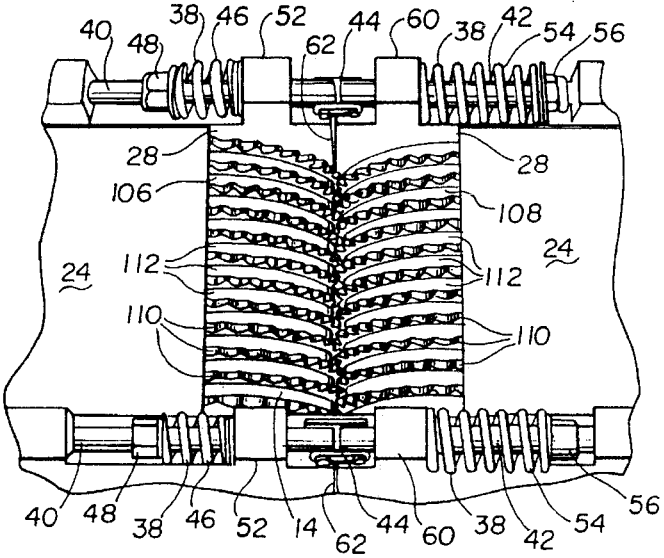
FIG. 2, is a top perspective view of the present invention showing the lateral displacement members interleaved sprocket rolls.

The crusher of the present invention is shown generally at 10 in the figures. The embodiment of crusher 10 as depicted in FIGS. 1 and 2 includes components comprising a case 11, drive units 12, 13, and crusher roll pairs 14, 15.

Case 11 of crusher 10 is comprised of case halves 16*a*, 16*b*. The case halves 16*a*, 16*b* are substantially identical, mirror images of one another. Each casing half 16*a*, 16*b* has an upper casing 17, a lower casing 18 and a spacer 20 interposed therebetween. Each upper casing 17, lower casing 18 and spacer 20 is comprised of a front face, an opposed rear faced, and an interconnecting side face. The fourth side thereof is open and is the side of each casing half 16*a*, 16*b* that faces the opposed casing half 16*a* or 16*b*. The case 11 is formed of steel plate that is approximately one half inch to three-quarters inch thick in order to provide substantial support for the crushing components of crusher 10.

Each casing half 16*a*, 16*b* has a partial top plate 24 and a partial bottom plate 26. A feedstock intake 28 is defined between the two partial top plates 24. A feedstock outlet 30 is defined between the two bottom plates 26. The case 11 is assembled on a frame 32. The frame 32 is comprised of box section, steel components that are preferably joined by weldments. Frame extensions 34 are coupled to frame 32 and are attached by cap screws 35 to the upper casing 17, lower casing 18 and spacer 20 of the respective casing halves 16*a*, 16*b*.

Four lateral expanders are affixed to case 11: two upper lateral expanders 38 and two lower lateral expanders 39. The lateral expanders 38, 39 permit a controlled amount of lateral displacement between casing halves 16*a*, 16*b* responsive to the passage of a substantially incompressible bulk component of feedstock, such as an end cap through the crusher roll pairs 14, 15. The upper lateral expanders 38 and the lower lateral expanders 39 are virtually identical in construction.

Lateral expanders 38, 39 include a fixed shaft 40 and a moveable shaft 42. The fixed shaft 40 and moveable shaft 42 are connected by a chain link 44. Chain link 44 accommodates a certain amount of flexure between fixed shaft 40 and moveable shaft 42 during lateral separation of casing halves 16*a* and 16*b*.

Fixed shaft 40 is held at a fixed position relative to casing half 16*a*. A nut 48 is threaded onto fixed shaft 40. Nut 48 is tightened into compressive engagement with sleeve 46 and washer 50. Sleeve 46 and washer 50 have suitable bores defined therein such that sleeve 46 and washer 50 are maintained in a sliding engagement with fixed shaft 40. Stop block 52 has a suitable bore defined therein that permits the sliding engagement of fixed shaft 40 therein. Stop block 52 is formed integral with casing half 16*a*. Tightening nut 48 against sleeve 46 causes washer 50 to compressively abut stop block 52. Such action fixes the fixed shaft 40 in position relative to casing half 16*a*.

Moveable shaft 42 is threaded and has spring 54, nut 56 and washer 58 mounted thereon. A suitable bore defined within stop block 60 accommodates the lateral translation of moveable shaft 42 therethrough. Nut 56 bears upon washer 58 and thereby holds spring 54 in a selected state of compression with stop block 60. The spring 54 acts to bias the casing halves 16*a*, 16*b* into engagement along mating juncture 62. Lateral translation of moveable shaft 42 to the left, as depicted in FIG. 2, acts to increase the compression of spring 54, thereby increasing the bias exerted by spring 54 urging the casing halves 16*a*, 16*b* into engagement along mating juncture 62 after the passage of a substantially incompressible bulk component of feedstock.

The drive units 12, 13 of crusher 10 include a number of identical and like numbered components. An advantage of this embodiment of the invention is that by incorporating virtually mirror image casing halves 16*a*, 16*b* and drive units 12, 13, the crusher 10 is inherently balanced. Such balancing acts to minimize the generation of torque forces that would potentially exert wear-causing moments on the various components of the crusher 10 during crushing operations.

Each drive unit 12, 13 includes a motor 68. In a preferred embodiment, each motor 68 is a commercially available one horse power electric motor. Motor 68 is coupled to a gear box 70. Gear box 70 in the preferred embodiment is a worm type unit that provides an output rotation that is oriented transverse to the input shaft from motor 68. It is understood that other types of gear arrangement, such as for example a spur gear arrangement, can be utilized in the present invention.

The gear box 70 supports the motor 68 and is affixed to a cantilevered mount 72. Cantilevered mount 72 is formed of box section steel components and is mounted pivotally at pivot 74 to frame 32. The output drive shaft 76 of gear box 70 is coupled to drive sprocket 78 by key 80. A drive chain 82 is engaged with the teeth of drive sprocket 78.

The drive chain 82 is tensioned by the cantilevered weight of motor 68 and gear box 70 acting about pivot point 74. The amount of tensioning force experienced by drive chain 82 is a function of the length of drive chain 82, in that increasing the length of drive chain 82 increases angle between cantilevered mount 72 and frame 32. This in turn increases the effective lever arm through which the weight of motor 68 and gear box 70 acts with respect to pivot point 74, thereby increasing the tensioning force acting upon the drive chain 82.

The drive chains 82 are wound around and rotationally drive the respective upper crusher drive sprockets 84*a* or 84*b* and the associated lower crusher drive sprocket 86 that is disposed in the same casing half. The upper crusher drive sprockets 84*a*, 84*b* are connected to drive shaft 88 by key 90. The lower crusher drive sprocket 86 is connected to drive shaft 98 by key 100. It should be noted that the diameter of upper crusher drive sprocket 84*b* is less than the diameter of upper crusher drive sprocket 84*a*. Accordingly, for the same rotational speeds of the two drive sprockets 78, the rotational speed of upper crusher drive sprocket 84*b* is substantially greater than the rotational speed of upper crusher drive sprocket 84*a*. In a preferred embodiment, the rotational speed ratio between upper crusher drive sprocket 84*b* and upper crusher drive sprocket 84*a* is preferably three: four.

In an embodiment, the aforementioned drive sprockets 84*a*, 84*b*, and 86 are included only on a single side of case 11 of crusher 10. No drive components similar to those previously described are provided on the opposing side of case 11. Alternatively, an identical drive system having drive sprockets 84*a*, 84*b*, and 86 may be included on both sides of case 11 of crusher 10. Such arrangement acts to balance the torque of the drive system and to provide redundancy in the event that one drive chain 82 breaks during operation.

Referring to FIG. 2, crusher roll pair 14 is comprised of sprocket crushers 106, 108. In the preferred embodiment, each such sprocket crusher 106, 108 is formed of a plurality of sprockets 110 with a spacer 112 disposed between adjacent sprockets 110. Sprockets 110 and spacer 112 of sprocket crusher 106, 108 alternate such that the sprockets 110 of sprocket 106 are opposed to the spacers 112 of sprocket 108 and the sprockets 110 of sprocket crusher 108 are opposed to the spacers 112 of sprocket 106. This arrangement provides that the sprockets 110 of sprocket crushers 106, 108 are interleaved, but not touching, when the casing halves 16*a*, 16*b* are in engagement along mating juncture 62. It should be noted that the sprocket crushers 106, 108 do not drive one another.

In a preferred embodiment, each sprocket 110 is formed with an attached spacer 112, although the sprockets 110 and spacers 112 could separate components. Each sprocket 110 is keyed to drive shaft 88. The width of the sprocket 110 and the spacer 112 are approximately equal. The ratio of the width of the sprocket 110 to the spacer 112 is a factor in determining the size of the feedstock particles and may be altered as desired to achieve a desires particle size. The diameter of the spacer 112 is generally equal to the diameter of the sprocket 110 taken at the base of the teeth 114 of the sprocket 110. The teeth 114 are generally triangular shaped and are inwardly tapered, such that the point of teeth 114 is slightly narrower than the base of teeth 114. Different shaped teeth may be utilized to achieve a desired feedstock particle size.

In the preferred embodiment depicted in FIGS. 1–4, the crusher roll pair 15 that comprises the lower roll pair, has sprocket crushers 116, 118 that are substantially identical to the sprocket crushers 106, 108. By including an additional spacer 20 and lower casing 18, a third crusher roll pair may be cascaded with the previously described crusher roll pairs 14, 15 of crusher 10, as needed.

Figure 3:
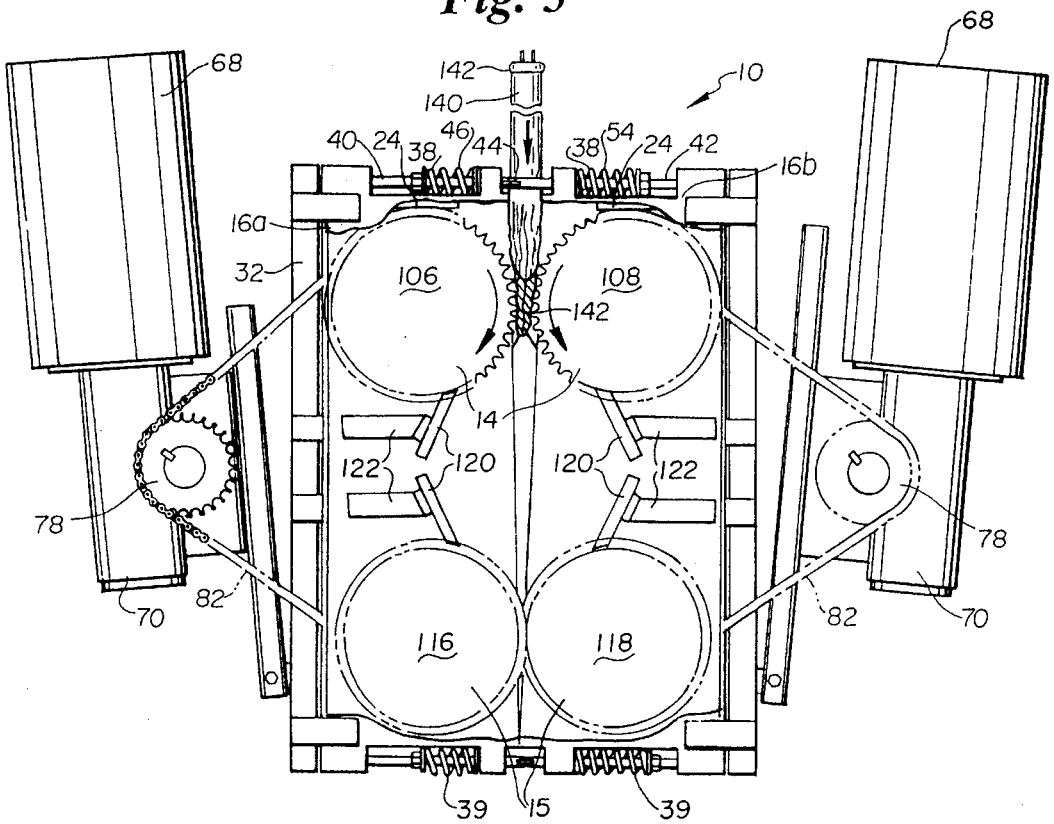
FIG. 3 is a side elevational view of the crusher with portions of the casing broken away to reveal the two pairs of sprocket rolls and showing the upper pair of sprocket rolls processing an aluminum end cap.
Figure 4:
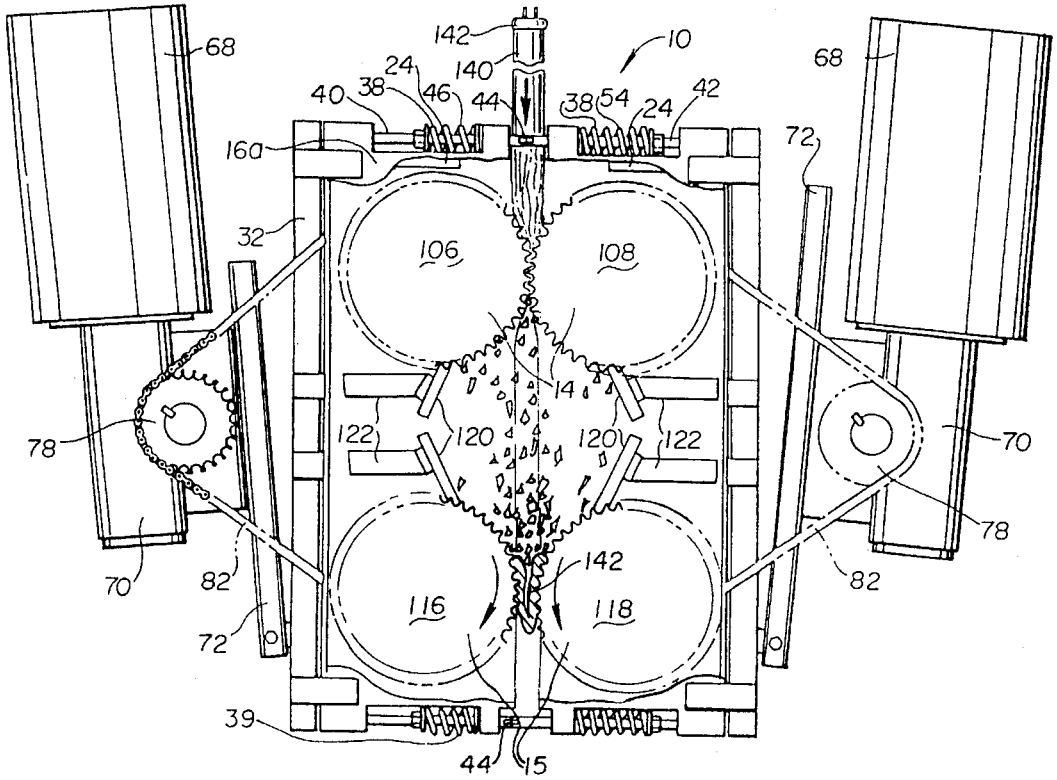
FIG. 4 is a side perspective view of the crusher with portions of the casing broken away showing the lower pair of sprocket rolls processing aluminum end cap.

FIGS. 3 and 4 depict strippers 120 mounted to stripper mounts 122. The scraper mounts are in turn fixed to the spacers 20 of the casing halves 116*a*, 116*b*. The spacers 120 have a series of grooves defined therein that correspond to the teeth 114 of each of the sprockets 110 making up a sprocket crusher 106, 108 or sprocket crusher 116, 118. The strippers 120 are so disposed that the teeth 114 of the sprockets 110 passed through the grooves defined therein. The strippers 110 are effective in preventing the aluminum components of the fluorescent bulbs from becoming jammed in the sprocket 110. Further, the strippers 120 help define a central channel within casing 11 through which the bulbs comprising the feedstock pass from the feedstock intake 28 to the feedstock outlet 30.

Figure 5:
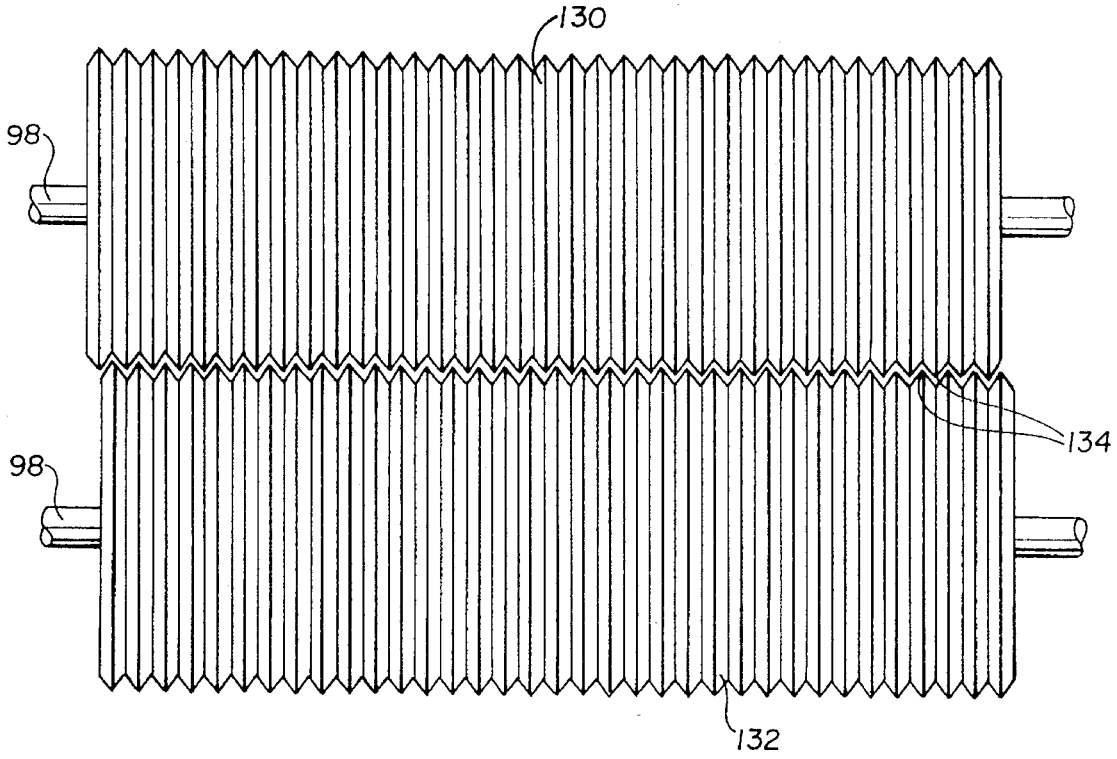
FIG. 5 is a side top view of an alternative embodiment of a lower crusher roll.

FIG. 5 depicts an alternative set of crusher drums 130, 132 that are used in place of the sprocket crushers 116, 118 comprising crusher roll pair 15 as depicted in FIGS. 1, 3 and 4. It has been determined that the crusher roll pair 14 having the interleaved sprockets 110 results in a substantial portion of the total crushing experienced by a fluorescent bulb in transmitting crusher 10. Accordingly, it may be desirable to utilize a somewhat less aggressive apparatus for crusher roll pair 15.

FIG. 5 depicts crusher drums 130, 132 mounted on drive shafts 98. Crusher drums 130, 132 have a generally smooth exterior surface in which a series of closely spaced circumferential grooves 134 have been inscribed. Such grooves 134 assist in pulling the already partially reduced feedstock, received from the crusher roll pair 14, between the crusher drums 130, 132. The crusher drums 130, 132 are positioned in close proximity to one another such that there is interleaving of the grooves 134 of crusher drum 130 with the grooves 134 of crusher drums 132. As in the case of sprocket crushers 116, 118, the grooves 134 of crusher drum 130 do not touch the grooves 134 of crusher drums 132.

The grooves 134 depicted in FIG. 5 are generally triangular in cross sectional shape, with the base thereof integral with the crusher drums 130, 132. Alternatively, the circumferential grooves 134 may rectangular or semi-circular in cross-section. As previously indicated, with such cross sectional shapes, there is interleaving of the grooves 134, but the grooves 134 of crusher drums 130 do not touch the grooves 134 of crusher drums 132.

Figure 6:
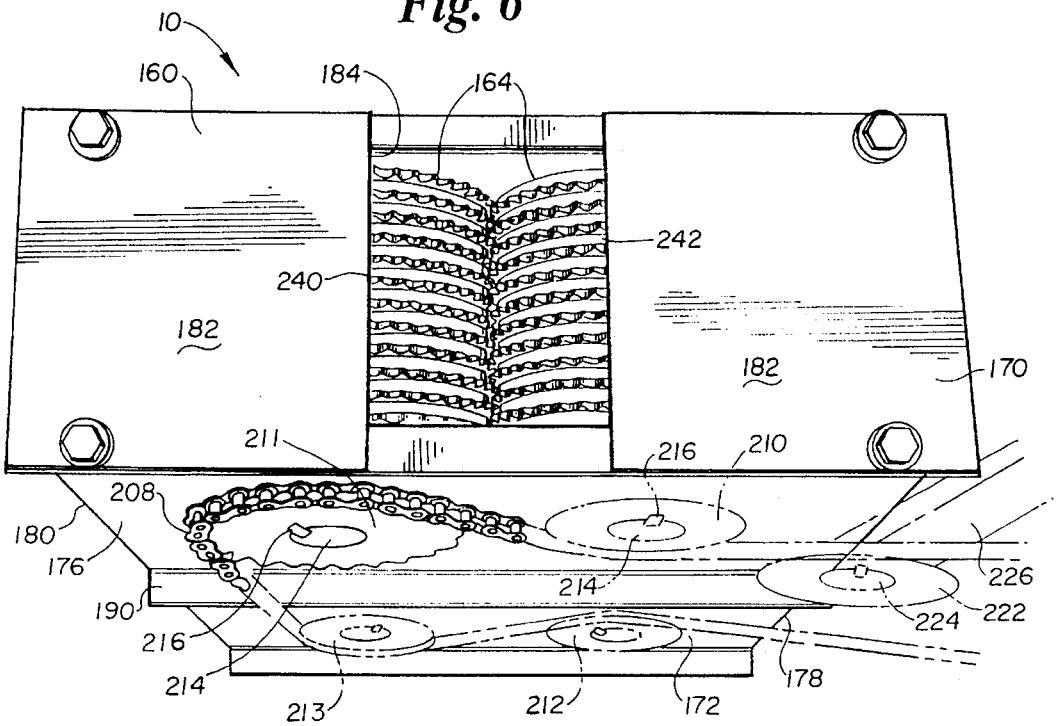
FIG. 6 is a top perspective view of an alternative embodiment of the present invention utilizing a single drive motor and gear box.
Figure 7:
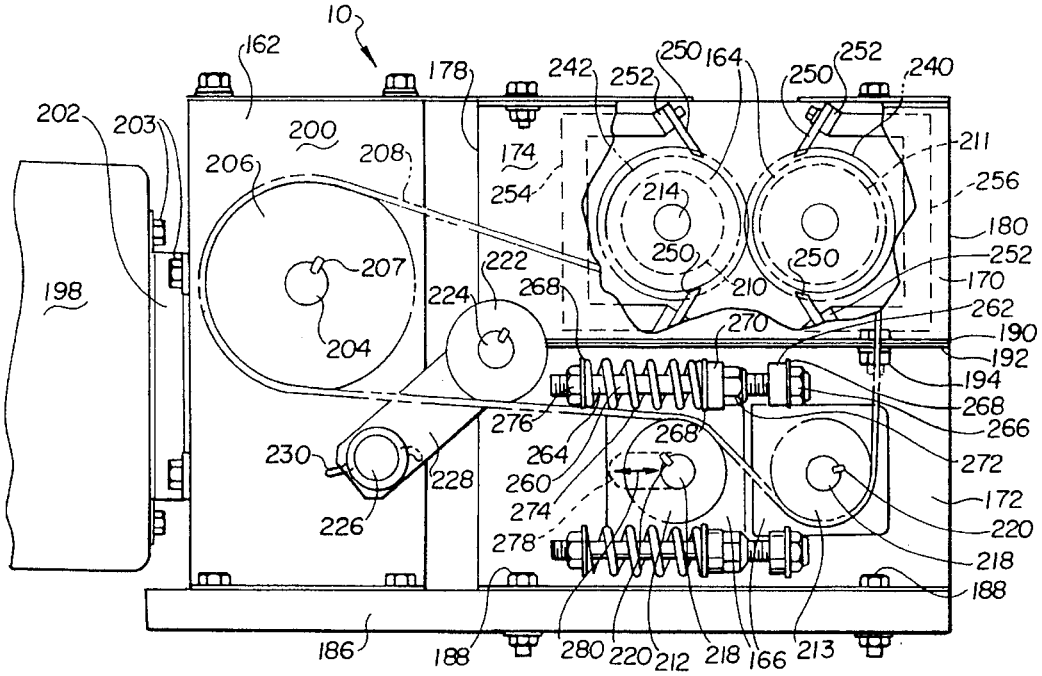
FIG. 7 is a side elevational view of the alternate embodiment depicted in FIG. 6.

FIGS. 6 and 7 depict an alternative embodiment of the crusher 10. The crusher 10 includes major components comprising a case 160, a drive unit 162 and crusher roll pairs 164, 166.

The case 160 is comprised of an upper casing 170 and a lower casing 172. The upper casing 170 and a lower casing 172 are each formed of steel material and are approximately one half inch thick in order to afford substantial support for the crushing procedures. The case 170 is generally rectangular in shape and has a front face 174 and an opposed rear face 176 with two opposed side faces 178, 180. The side face 178 faces toward the drive unit 162.

The upper casing 170 has partial top plates 182. A feedstock intake 184 is defined between the two partial top plates 182. The bottom of lower casing 172 has partial bottom plates (not shown) that are similar to the partial top plates 182. A feedstock outlet (not shown) is defined between the two bottom plates. The case 160 is assembled on a frame 186. The frame 186 is comprised of box section, steel components that are preferably joined by weldments. The case 160 is mounted to frame 186 by bolts 188. The upper casing 170 and lower casing 172 are joined at flanges 190, 192 by bolts 194.

The drive unit 162 includes a motor 198. In a preferred embodiment, the motor 198 is a commercially available two to three horse power electric motor. For applications having a relatively high content of large feedstock components, such as the end caps of mercury vapor lamps, the motor 198 can be increased to a five horsepower unit that has the requisite torque to efficiently process such feedstock components. Alternatively, the gearing can be lowered to achieve the desired torque.

Motor 198 is coupled to a gear box 200 by a mount 202. The coupling is effected by bolts 203. The gear box 200 in the preferred embodiment is a worm type unit that provides an output rotation that is oriented transverse to the input shaft from motor 198. It is understood that other types of gear arrangement can be utilized in the present invention. The output drive shaft 204 of gear box 200 is coupled to drive sprocket 206 by key 207. A drive chain 208 is engaged with the teeth of drive sprocket 206.

The drive chain 208 is wound around and rotationally drives the upper crusher drive sprockets 210, 211 and a lower crusher drive sprockets 212, 213. The winding of the drive chain 208 is such that the sprockets 210 and 211 are counter rotating and the sprockets 212 and 213 are counter rotating. The sprockets 210 and 212 rotate in the same direction and the sprockets 211 and 213 rotate in the same direction. The upper crusher drive sprockets 210, 211 are connected to the respective drive shafts 214 by keys 216. The lower crusher drive sprockets 212, 213 are connected to the respective drive shafts 218 by key 220. In the preferred embodiment, the aforementioned sprockets are included on both the front face 174 and the rear face 176 of the case 160 of crusher 10.

The drive chain 208 is tensioned by tensioner pulley 222. The pulley 222 is rotationally mounted on shaft 224. The shaft 224 is in turn mounted to arm 226. The shaft is mounted to gear box 200. A tensioning spring 230 is disposed on the shaft 228 and acts to bias the tensioner pulley 22 in a clockwise direction about the shaft 228, as depicted in FIG. 8. The amount of tensioning force experienced by drive chain 208 is a function of the bias exerted by the spring 230 acting through the arm 226.

The crusher roll pair 164 is comprised of sprocket crushers 240, 242. In the preferred embodiment, each such sprocket crusher 240, 242 is formed of a plurality of sprockets 244 with a spacer 246 disposed between adjacent sprockets 244. The sprockets 244 and spacers 246 of sprocket crushers 240, 242 alternate such that the sprockets 244 of sprocket crusher 240 are opposed to the spacers 246 of the sprocket 2452 and the sprockets 244 of sprocket crusher 242 are opposed to the spacers 246 of the sprocket crusher 240. This arrangement provides that the sprockets 244 of the respective sprocket crushers 240, 242 are interleaved when the casing halves 16*a*, 16*b* are in engagement along mating juncture 62.

In a preferred embodiment, each sprocket 244 is formed with an attached spacer 246, although the sprockets 244 and spacers 246 could as well be separate components. Each sprocket 244 is keyed to drive shaft 214. The width of the sprockets 244 and the spacer 246 are approximately equal. The diameter of the spacers 246 are generally equal to the diameter of the sprockets 244 taken at the base of the teeth 248 of the sprocket 244. The teeth 248 are generally triangular shaped and are inwardly tapered, such that the point of teeth 248 is slightly narrower than the base of teeth 248.

In the preferred alternative embodiment depicted in FIGS. 6 and 7, the crusher roll pair 166 that comprises the lower roll pair, has sprocket crushers (not shown) that are substantially identical to the sprocket crushers 240, 242. A third crusher roll pair may be cascaded with the previously described crusher roll pairs 164, 166 of crusher 10, as needed. Also, the crusher drums 130, 132 that are depicted in FIGS. 5 and 6 may be utilized for the crusher roll pair 166 that comprises the lower roll pair, as desired.

Strippers 250 are mounted to scraper mounts 252. The scraper mounts are in turn fixed to the carriages 254, 256, shown partially in phantom in FIG. 7, that the sprocket crushers 240, 242 respectively are mounted in. The strippers 250 have a series of grooves defined therein that correspond to the teeth 248 of each of the sprockets 244 making up a sprocket crusher 240, 242 or the similar lower sprocket crushers. The strippers 250 are so disposed that the teeth 248 of the sprockets 244 pass through the grooves defined therein as the sprockets 244 rotate. The strippers 250 are effective in preventing the aluminum components of the fluorescent bulbs from becoming jammed in the sprocket 244. Further, the strippers 120 help define a central channel within casing 160 through which the bulbs comprising the feedstock pass from the feedstock intake 184 to the feedstock outlet (not shown).

The carriage 256 of the sprocket crusher 240 is stationary and fixed to the case 160. The carriage 254 of the sprocket crusher 242 is translatable to accommodate the translating motion of the sprocket crusher 242 away from the sprocket crusher 240 in order to process a relatively large component of feedstock. The carriage 254 has four expanders 260 associated therewith to control the translation. The expanders 260 are located two to a side of the casing 160, as depicted associated with the lower crusher drive sprocket 212.

A stop block 262 is affixed to the casing 160. The threaded, fixed shaft 264 is disposed in a bore (not shown) defined in the stop block 262. The nut 266 bears on the washer 268 and fixedly positions the shaft 264. A second stop block 270 is fixedly coupled to the translatable carriage 254. The travel of the second stop block 270 and hence, the sprocket crusher 242 to the right, as depicted in FIG. 7, is limited by the jam nut 272 that is positioned on the fixed shaft 264. The spring 274 is held in compression between the washers 268 and in engagement with the stop block 270 by the compression nut 276. The bias of the spring 274 urges the stop block 270 into engagement with the jam nut 272. Passage of a large component of feedstock through the sprocket crushers 240, 242 forces the sprocket crusher 242 to the left. The position of sprocket crusher 240 within case 160 is fixed. The stop block 270 then translates to the left and further compresses the spring 274, thereby increasing the bias acting to return the sprocket crusher 242 to the interleaved position depicted in FIGS. 7 and 8 after passage of the large component of feedstock. The translation of the sprocket crusher 242 is accommodated by the slot 278 defined in the case 160 through which the drive shaft 214 passes. The translation is as indicated by the arrow 280.

The aforementioned translation of the sprocket crusher 242 to the left causes a certain amount of slack to occur in the drive chain 208. If unaccounted for, this slack would cause the drive chain 208 to skip over the teeth of the drive sprocket 206. This is an undesirable condition since it results in greatly increased wear of both the drive sprocket 206 and the drive chain 208. The tensioner pulley 222 is incorporated in order to maintain the tension in the drive chain 208 as the slack is introduced into the drive chain 208, the tensioner pulley 222 is rotated in a clockwise direction as depicted in FIG. 7 by the biasing action of the spring 230 and the slack in the drive chain 208 is taken up.

In operation, the fluorescent bulbs 140 are typically dropped into a lengthy inlet chute (not shown). The shock of the impact of the fluorescent bulb 140 on the crusher roller pair 14 tends to break the bulb on the sprocket teeth 114 progressively prior to passage through crusher roll pair 14. With the sprocket crusher 108 running at a greater rotational speed than the sprocket crusher 106, the action breaking the glass is essentially that of putting the glass across a fulcrum formed by two teeth 114 on adjacent sprockets 110 of sprocket crusher 106 and tensionally breaking the glass in the center with a faster rotating tooth 114 on the interleaved sprocket 110 of sprocket crusher 108. The tensional breaking is a high shock method of breaking that helps promote the separation of the fluorescent powder coating and mercury vapor from the glass pieces so that such fluorescent powder and mercury vapor may be suitably collected.

Referring to FIGS. 3 and 4, the bulb 140 can be seen with the first end cap 142 passing between crusher sprockets 106, 108. In the depiction of FIG. 3, the end cap 142 has forced the casing halves **16*a* and 16*b* apart along juncture 62. This action draws moveable shaft 42 to the left, compressing spring 54 of lateral expander 38. As end cap 142 passes between sprocket crushers 106, 108, sufficient deformation occurs to separate plastic components and conducting metallic components from the aluminum end cap 142. After end cap 142 passes between sprocket crushers 106, 108 spring 54 acts to shift moveable shaft 42 to the right, again causing the casing halves 16*a*, 16*b* into engagement along the mating juncture 62**.

Referring to FIG. 4, the end cap 142 of the bulb 140 is depicted passing between sprocket crushers 116, 118. Similar expanding and contracting lateral action of lateral expander 39 as described above for lateral expander 38 occurs during passage of end cap 142 and subsequent thereto.

In the preferred embodiment, the drive sprockets 78 are driven at a rotational speed range of between 60 and 180 revolutions per minute. At times during which substantial quantities of debris are being delivered to crusher 10 along with fluorescent bulbs 140, the rotational speed of drive sprocket 78 is reduced to the lower portion of the range in order to have a substantial amount of torque available to overcome the compressive bias of springs 54 as the debris passes between the crusher roll pair 14, 15. The rotational speed of drive sprockets 78 can be increased to the higher portion of the range where it is known that the feedstock into crusher 10 is limited only to fluorescent bulbs 140 and mercury vapor lamps. Both of the embodiments depicted may be reversed in the direction of rotation in order to clear any jams that may occur. Such jams are not a frequent occurrence and are usually the result of non-bulb type debris that is introduced along with the bulb feedstock to be crushed. A rotational reversal is effective in clearing such jams.

The present invention has been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

We claim:

1. A crusher adapted to process a feedstock, comprising:

a case having a first and a second casing half, each such casing half defining a generally rectangular shape having first and second opposed side margins and an interconnecting end margin with an open end margin opposed thereto, the first and second casing halves being in registry along the respective open margins thereof;

a first pair of crusher rolls adapted to process a feedstock being rotationally disposed within the case between the first and second opposed side margins with a first crusher roll of the first pair of crusher rolls being disposed in the first casing half and a second crusher roll of the first pair of crusher rolls being disposed in the second casing half, each crusher roll thereof having a central axis about which the crusher roll rotates, the central axes of the first and second crusher rolls being disposed in a parallel spaced apart relationship, a plurality of spaced apart circular sprockets being disposed along the central axis of each crusher roll, each such sprocket having a plurality of teeth formed circumferentially around the sprocket, the sprockets of the first crusher roll being interleaved with the sprockets of the parallel second crusher roll; and a first lateral displacement device operably coupling the casing halves of the case acting to accommodate the lateral displacement of the first and second crusher rolls of the first crusher roll pair responsive to the processing of a relatively large piece of feedstock and having a biasing member acting to urge the casing halves into registry along the respective open margins thereof subsequent to the processing of the relatively large piece of feedstock.

2. The crusher of claim 1 further comprising:

a second pair of crusher rolls so disposed within the case as to receive processed feedstock from the first pair of crusher rolls and adapted to further process the feedstock with a first crusher roll of the second pair of crusher rolls being disposed in the first casing half and a second crusher roll of the second pair of crusher rolls being disposed in the second casing half, each crusher roll thereof having a central axis about which the crusher roll rotates, the central axes of the first and second crusher rolls being disposed in a parallel spaced apart relationship, and the first and second crusher rolls each having surface characteristics adapted to cooperatively process the feedstock; and a second lateral displacement device operably coupling the casing halves of the case acting to accommodate the lateral displacement of the first and second crusher rolls of the second crusher roll pair responsive to the processing of a relatively large piece of feedstock and having a biasing member acting to urge the casing halves into registry along the respective open margins thereof subsequent to the processing of the relatively large piece of feedstock.

3. The crusher of claim 2 further comprising:

first drive system operably supported by the first casing half having a driver sprocket and a driving chain, the driving chain being drivingly coupled to the first crusher roll of the first crusher pair and the first crusher roll of the second crusher pair; and second drive system operably supported by the second casing half having a driver sprocket and a driving chain, the driving chain being drivingly coupled to the second crusher roll of the first crusher pair and the second crusher roll of the second crusher pair.

4. The crusher of claim 3 wherein the first drive system is mounted to the first casing half on a first rotatable cantilevered mount and the second drive system is mounted to the second casing half on a second rotatable cantilevered mount.

5. The crusher of claim 3 wherein the first and second crusher rolls of the second pair of crusher rolls each have an external processing surface, the external processing surfaces of the first and second crusher rolls each having a plurality of circumferential grooves defined therein.

6. The crusher of claim 5 wherein the circumferential grooves defined in the external processing surface of the first crusher roll of the second pair of crusher rolls are interleaved and spaced apart from the circumferential grooves defined in the external processing surface of the second crusher roll of the second pair of crusher rolls.

* * * * *